US005785321A

United States Patent [19]

van Putten et al.

[11] Patent Number: 5,785,321

[45] Date of Patent: Jul. 28, 1998

[54] ROULETTE REGISTRATION SYSTEM

[76] Inventors: Mauritius Hendrikus Paulus Maria van Putten, Terrace Apartments #2C-3, 402 E. Buffalo St., Ithaca, N.Y. 14850; Pascal Ferdinand Antonius Maria van Putten, Acquariuslaan 62, 5632BD Eindhoven, Netherlands

[21] Appl. No.: 665,239

[22] Filed: Jun. 17, 1996

[30] Foreign Application Priority Data

Sep. 25, 1995 [NL] Netherlands ..... 1001280

[51] Int. Cl.[6] ..... A63F 9/24

[52] U.S. Cl. ..... 273/309

[58] Field of Search ..... 273/236, 237, 273/238, 288, 309; 463/12, 16, 25; 364/412; 40/27.5

[56] References Cited

U.S. PATENT DOCUMENTS

| | | | |
|---|---|---|---|
| 4,527,798 | 7/1985 | Siekierski et al. | 273/86 R |
| 4,573,681 | 3/1986 | Okada | 273/143 R |
| 4,665,502 | 5/1987 | Kreisner | 364/900 |
| 4,692,863 | 9/1987 | Moosz | 364/412 |
| 4,819,818 | 4/1989 | Simkus et al. | 273/138 A |
| 4,858,122 | 8/1989 | Kreisner | 364/410 |
| 5,102,134 | 4/1992 | Smyth | 273/138 A |
| 5,204,671 | 4/1993 | Kronberg | 340/825.65 |
| 5,651,548 | 7/1997 | French et al. | 273/309 |

*Primary Examiner*—George Manuel

[57] ABSTRACT

A Roulette Registration System is described for real-time registration of the proceeds in roulette games. The system uses a method in which the collective bet is considered as an ensemble of stacks of coins, each of which is analyzed for its composition (with coins identified by type, with reference at least to their monetary value) and location (on the table, defining the particular bet associated with the stack). The implementation of the method utilizes so-called 'smart coins,' which allow for communication (of their monetary values) among themselves and to the table. Thus, each stack autonomously determines its stack composition, which is subsequently transmitted to the table. The table is endowed with a cartesian sensing grid, via which the stack composition data are communicated to a central registration system. Sufficient spatial resolution of the cartesian sensing grid further allows accurate determination of the stack locations, by resolving the coordinates of the spot on the table where the stack transmitted its stack composition data. In this fashion, the particular bet associated with a stack is completely determined. The registration system applies to the registration of the proceeds of games for obtaining data for statistical analysis, for enabling real-time faithful representation at remote sites and for supervising the proceeds as an anti-fraud measure.

12 Claims, 1 Drawing Sheet

ROULETTE REGISTRATION SYSTEM

SUMMARY

A Roulette Registration System is described for the purpose of real-time registration of the proceeds in roulette games. The method partitions a collective bet in terms of stacks, each of which is analyzed for its composition (type and number of coins with a particular monetary value) and location (on the table, defining the particular bet associated with the stack). The method is implemented by so-called 'smart coins,' which allow for communication of the monetary values of the individual coins among themselves. Thus, each stack autonomously determines its composition, and subsequently transmits this to the table. The table is endowed with a cartesian sensing grid, via which the stack composition is transmitted to a central registration system. The cartesian sensing grid has sufficient spatial resolution to determine coordinates of the spot at which a stack composition is received. Together with the stack composition, the bet associated with a stack is thus completely determined. The registration system has applications for statistical analysis, real-time faithful representation at remote sites, and supervision of the proceeds as an anti-fraud measure.

BACKGROUND OF THE INVENTION

Roulette is a casino game which enjoys world-wide popularity. The emergence of the Internet (and its future descendents) suggests to look for ways to extend participation by including remote players at distant sites. Participation by remote players requires means for a faithful representation of the proceeds of the game at distant sites. This has motivated the present disclosure for a Roulette Registration System (RRS).

RRS also provides data for advanced statistical analysis. In particular, it offers the data needed for in-depth analysis of collective bet behavior of the participants. Studies of this kind can be utilized by casino management in strategies for optimizing profit by varying minimum/maximum bet rules. RRS further serves to supervise the games proceeds, at a level which surpasses that possible by the existing methods of supervision by personnel or video. Indeed, supervision by RRS applies to the proceeds of the game as a whole, including both handling of the game by the operating personnel and the participating players. RRS, therefore, offers a new and fully rigorous anti-fraud measure.

To summarize, RRS offers the casinos the means for:

(i) Enlarging and broadening customer base through remote participation.

(ii) Obtaining databases on roulette games for statistical analysis.

(iii) Supervising the detailed proceeds of roulette games.

(iv) Registration of improper proceeds in a roulette game.

SUMMARY OF THE INVENTION

The method disclosed herein pertains to electronic registration of the collective bet: the ensemble of coins put in place as bets by the group of players. A collective bet is a distribution of coins on the table organized in separately placed coins, and coins which are stacked. Without loss of generality, we shall regard a collective bet as organized in stacks, with the understanding that stacks can consist of a single coin. Stacks are understood in terms of the physical coins. Coins are distinguished by type, which in particular orders coins by their monetary values. For example, two (physically) individual coins are said to be identical when their types match (with at least sharing the same monetary value). The type of a given coin is contained in its coin identification data (CID).

The method comprises three steps (not all of which are sequential in time). In the first step, the composition of each stack is evaluated, and described in its stack composition (SC). That is, the SC describes a stack in terms of its coins by type and associated multiplicity (number of occurrences). For example, a stack of two coins of one monetary unit, five coins of ten monetary units and one coin of fifty monetary units has SC=2×1, 5×10, 1×50, not necessarily in this order. In the second step, the location (L) of every stack on the table is determined, thereby obtaining the combinations of SC and L (SCL). In the third step, the SCL's of the stacks in the collective bet are transmitted to a central registration unit, e.g., a computer with memory for storage of the SCL's associated with a collective bet.

More specifically, the SCL is obtained and sent to the central registration system by means of communication between coins (within the same stack) and from coins (the ones at the bottom of a stack) to the table. To this end, use is made of 'smart coins' which contain their coin identification data (CID), with reference, as mentioned before, at least to the monetary value printed on its housing. A smart coin further has the ability to processes its CID by a transmit or receive command to a neighboring coin within the same stack. A smart coin processing a CID operates in either of two modes:

(i) propagation mode (PM), or (ii) broadcast mode (BM).

Here, a coin operates in PM to communicate a CID of an adjacent coin at one side (e.g. on top of it) to either an adjacent coin at the other side of it (e.g. underneath), or to the table. By default, a smart coin operates in propagation mode PM. A coin residing on the top of a stack determines its top level position using detection of light. A top level coin (a coin on the top of a stack) automatically switches to its broadcasting mode BM, and broadcasts its CID to whatever is below: another smart coin or the table. A broadcast of a CID is followed by an end of broadcast signal (EBS). A coin which is not in BM, and resides one or several levels below a top level coin, responds to detection of EBS (dEBS) by entering BM, broadcasting its own CID-EBS sequence, following by exiting BM. Note that a coin in this situation broadcasts its own CID-EBS sequence only after propagating one or more CID's received via and from the coin on top of it.

The method is now put in operation by having the coin at the top of a stack of n ($n \geqq 1$) coins begin with broadcasting its CID-EBS sequence. For clarity, the coins and their CID's and EBS's at the l-th level in the stack shall be referred to by a subscript l ($1 \leqq l \leqq n$). If there is no other coin underneath the top level coin, the stack comprises a single coin only (n=1), and the $CID_n$-$EBS_n$ sequence from the (top level) $coin_n$ transmitted directly into the table for registration by the central registration system. If, on the other hand, there is a coin residing underneath it (n>1), the underlying $coin_{n-1}$ will, being in PM by default, propagate $CID_n$ to either the table or to a second underlying coin, $coin_{n-1}$. Note that the subsequent $EBS_n$ is received, but not propagated by $coin_{n-1}$. In this fashion, the table communicates to the central registration system the location and the composition SC of each stack on the table in a 'top-down' fashion, by receiving a sequence of CID's, the CID of the top level coin being the first, and the CID of the bottom coin (touching the table) being the last to be received, which sequence of CID's is closed by a single EBS (generated by the bottom coin). For example, a stack of three coins will generate the sequence CID(top coin)-CID(middle coin)-CID(bottom coin)-EBS (bottom coin) for registration by the central registration system. More generally, the stack composition SC of a stack of size n is transmitted into the table by the bottom coin in the form of the sequence $$\overline{SC}=CID_n CID_{n-1} \ldots CID_1 EBS_1, \quad (0.1)$$

where $CID_n$ is transmitted first and $EBS_1$ terminates the transmission of the $\overline{SC}$. Here, the notation $\overline{SC}$ is used to refer to the actual sequence in the right hand-side of (0.1), in distinction from the SC as defined earlier in terms of a stack description by mere enumeration its coins by type and associated multiplicity. Of course, the SC is readily obtained from the $\overline{SC}$ by disregarding the order in which the CID's appear in $\overline{SC}$ and by grouping same CID, by including reference to the multiplicity with which a particular CID appears. Note that in the process of generating an $\overline{SC}$, $coin_l$ in the stack of size n carries out a cycle of operations consisting precisely of n–l times PM, followed by a single sequence of dEBS (of $EBS_{l+1}$ if l<n), $BM_l$ and $EBS_l$.

The method is completed by further endowing the table with a cartesian sensing grid (CSG) for receiving the $\overline{SC}$ and transmitting it to a central registration and processing system (RPS). The CSG can be made of X- and Y-pairs of electrical sensing lines in the case of micro wave transmission technology, thereby providing the ability to accurately resolve the spot at which the bottom coin of a stack carried out its transmission of $\overline{SC}$ into the table. The particular combination of X- and Y-pairs of electrical sensing lines activated in the transmission process of $\overline{SC}$ thus provide the RPS with the entire stack composition and location (SCL).

In the above process, the top level coin autonomously initiates the generation of the full $\overline{SC}$ sequence, that is, the complete SC, in its underlying stack. The top level coin is assumed to do so periodically, sufficiently frequently to ensure tracking of variations in stack compositions and locations in the course of a game (by participation of the players and personnel), while sufficiently slow to allow for registration. In this regard, frequencies of a few times or more per second seem reasonable.

SURVEY OF THE DRAWINGS

Implementation of RRS in a roulette table is shown in FIG. 1 and FIG. 2. Regarding the roulette table, the implementation is shown in FIG. 1, comprising a standard vilt V with the printed layout particular to roulette, and electrically conducting wires E (electric sensing lines) sandwiched between the vilt and the table (not shown). The electric sensing lines E are pair-wise orthogonally placed electrically conducting wires, which provide a two-dimensional electrically conducting grid aligned with the X and Y directions (a cartesian sensing grid CSG). FIG. 1 provides an 'open' view of the sandwich construction, showing further for illustrative purposes two coins C1 and C2, one of 5 and of 10 monetary units. Together with the two coins C1 and C2 is further indicated their location of micro wave transmission into the CSG by corresponding shadow-like disks in the 'closed,' operational situation, when vilt V and CSG are tightly packed together and layed flat on the table. Regarding the coins, the implementation is shown in 'open' view in FIG. 2, comprising electronic circuitry on a chip CH and coils Co1 and Co2. The casing of a coin consists of an upper and a lower plastic disk, HU and HL, respectively, HU containing Co1 and HL containing Co2. In between HU and HL is sandwiched the chip CH. The housing elements HU and HL further contain light sensing elements S1 and S2, respectively. Present, but not shown explicitly, are the power supply (e.g. a battery) for the chip CH and the electrical connections of the chip CH to coils Co1 and Co2 and to sensing elements S1 and S2.

DESCRIPTION OF THE PREFERRED EMBODIMENTS

Figure 1:
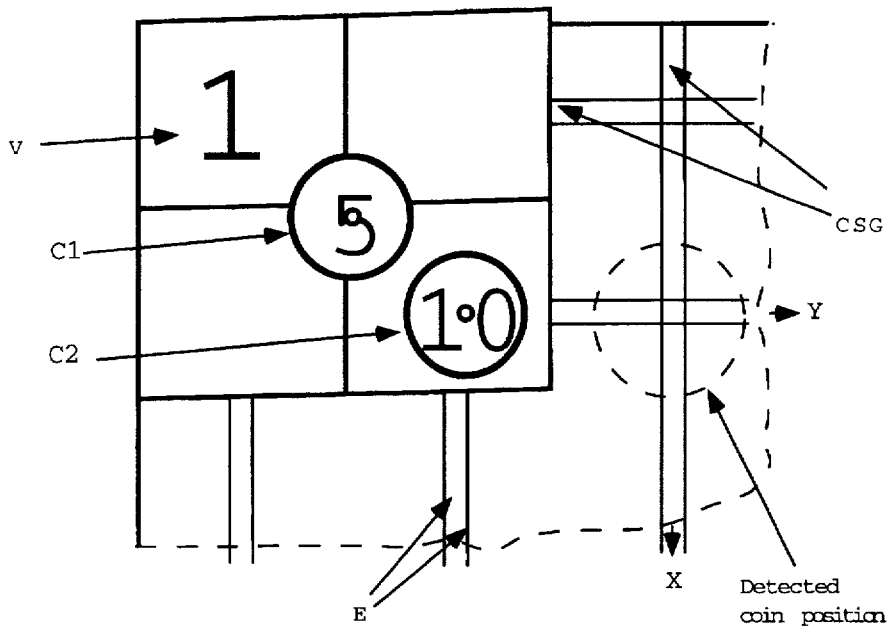
Figure 2:
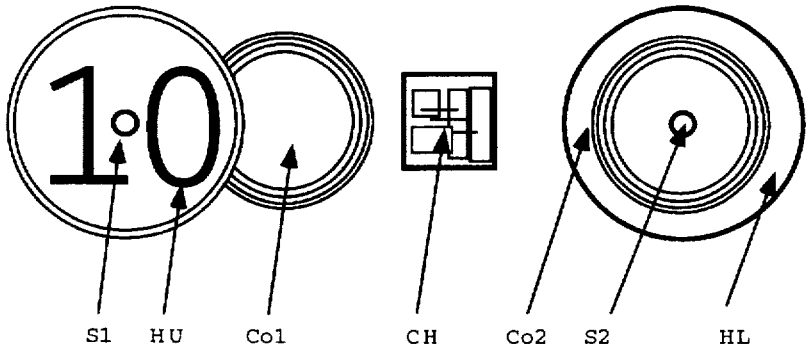

Referring more specifically to the drawings, for illustrative purposes the present invention is embodied in the implementation generally shown in FIG. 1 and FIG. 2. It will be appreciated that the embodiment of the invention may very as to the particular details if the parts without departing from the basic concepts as disclosed herein.

First Possible Implementation. Referring to FIG. 1 and FIG. 2, RRS can be realized using micro-wave technology. The basic hardware consists 'smart coins,' as shown in 'open' view in FIG. 2, each of which is endowed with an electronic chip CH connected to coils Co1 and Co2 for micro-wave receive or transmit operations by a coin, which components are encapsulated in between two plastic housing elements HU and HL. The receive or transmit operation is mediated through the table which is endowed with a cartesian sensing grid CSG composed of electric sensing lines E (FIG. 1). The smart coins contain two coils (Co1 at one side and Co2 at the other side), each for both transmit and receive operations. Smart coins use light sensing elements S1 and S2 as a means for determining whether or not they are on top of a stack (of coins): a coin determines itself to be at the top of a stack if precisely one of its sensing elements S1 or S2 detects light, otherwise it is within a stack with other coins on top of it. For example, the light sensing elements S1, S2 can be made of light sensitive resistors. It may be appreciated that the cartesian sensing grid CSG of FIG. 1 bears some relation to that found in ferrit-core memories. The cartesian sensing grid SCG is sandwiched between the printed vilt V (with the numbered layout of roulette) and the actual table (FIG. 1). A transmit command by a smart coin through activation of its coil facing the table is received by the precisely two intersecting pairs of orthogonal wires from the cartesian sensing grid SCG through induced magnetic flux. Such induced magnetic flux results in electrical potentials generated in each of forementioned pairs of electric sensing lines, namely an X-pair and a Y-pair. Together, a combination of an X- and Y-pair uniquely determine the (X,Y)-coordinates associated with forementioned transmitting coin, and hence the coordinates of the stack associated with the transmitted SC.

More specifically to the chips CH in the smart coins, we mention that each CH contains the coin identification data CID in its memory for determination of its type, comprising at least the monetary value printed on its housing. The chip of a coin processes its CID by a transmit or receive command to either of its coils Co1, Co2. As mentioned before, the CID processing operates in either of the two modes (i)propagation mode (PM), or (ii)broadcast mode (BM). In the present embodiment, PM refers to a receiving of a CID by a micro wave signal detected by a coil at its upper (lower) side, say Co1 (or Co2), and transmitting the same CID by its lower (upper) side, Co2 (or Co1). By default, a smart coin operates in propagation mode PM. For example, PM may be achieved by interconnecting Co1 and Co2 directly, though an amplification of the CID micro wave signal by the chip CH may be preferred. A coin residing on the top of a stack determines its top level position using its light sensing elements, S1 or S2, one of them being activated by the surrounding light. A top level coin (a coin on the top of a stack) automatically switches to its broadcasting mode BM, and broadcasts its CID, using its lower coil in transmitting mode, to whatever is below: another smart coin or the table. A broadcast of a CID is followed by the end-of-broadcast signal EBS, using an additional micro wave signal. A coin which is not in BM, and resides one or several levels below a top level coin, responds to detection of EBS by entering BM, broadcasting its own CID-EBS sequence, following by exiting BM. Note that a coin in this situation broadcasts its own CID-EBS sequence only after propagating one or more CID's received from the coin on top of it.

The method is now put in operation by detection of light in one of the S1 or S2, whichever is facing upwards, by the coin at the top of a stack, which subsequently begins broadcasting its CID-EBS sequence. If there is no other coin underneath, and the stack comprises a single coin only, this CID-EBS sequence is received by the cartesian sensing grid SCG in the table and registered by the central registration system. If, on the other hand, there is a coin residing underneath it, the underlying coin will, being in PM by default, receive the CID-EBS using one of its Co1 or Co2, whichever is facing upwards, and propagate the CID to either the table or to a second underlying coin. Note that the subsequent EBS is received, but never propagated. In this fashion, a stack generates its own stack composition as a sequence of CID's terminated by a single EBS (generated by the bottom coin) in a 'top-down' fashion: the CID of the top level coin being the first, and the CID of the bottom level coin the last. The CID-EBS sequence (the complete $\overline{SC}$) is transmitted to the table through the bottom coin. The table, in turn, is connected to the central registration, where the complete stack composition SC is stored. To illustrate, a stack of three coins will generate the sequence CID (top coin)-CID(middle coin)-CID(bottom coin)-EBS(bottom coin) for registration by the central registration system. The localizing property of the cartesian sensing grid SCG is ensured by taking a sufficient density of X- and Y-pairs of electrical sensing lines, with which upon activation by a bottom coin of a stack (transmitting its CID-EBS sequence) the complete stack composition and location (SCL) is determined for registration.

Second Possible Implementation. The communication between the coins and from the coins to the table can further be realized using modern optical electronics comprising emitting and light sensing diodes, much akin to those used in optical sensors and opto-coupling devices. In this second implementation, the coils Co1 and Co2 from FIG. 2 are each replaced by light emitting and light sensing diodes (or combined into one physical element should this be possible), while the cartesian sensing grid CSG in the table is now constructed out of a large, table-sized two-dimensional array of light sensing diodes. In this implementation, optical technology working in the infrared wavelength is particularly preferred, allowing ready communication into the CSG through the vilt V, during transmission by the bottom coins into the table.

Of course, hybrids between the First and Second possible implementations are readily envisioned, e.g., one in which communication between the coins themselves takes place using the micro wave technology from the First (or optical technology from the Second), and using the optical technology from the Second (or micro wave technology from the First) for transmission by the bottom coins into the CSG in the table. In this regard, it is further conceivable to combine the light sensitive elements S1 and S2 with the optical replacements of the coils Co1 and Co2, respectively.

In any embodiment, it is required to a maintain proper power supply of the smart coins. While operation on batteries forms option, a further possibility is using electrovaltaic cells, much like those found in watches operating on sunlight. In the latter case, it may be appreciated that coins have sizable dimensions which provide substantial surface areas suitable for electrovaltaic cells. Modern chip technology, such as used in watches, allows for sufficiently low power operation that a simple capacitor will serve to smooth out variations in light strength during the various placements of the coins. Variations is light strength can be anticipated in the case coins placed within stacks, particularly when the latter are closely grouped themselves. Moreover, proper placement of the electrovaltaic cells on both UH and UL and on the rim of the coins will alleviate the diminishing effect of power in deeply stacked coins. Modern developments in the area of flexible electrovoltaic cells may be of particular interest in this respect.

Of course, it will be appreciated that in a final design arguments favoring one technological method over another are ultimately determined by a combination of aspects such as cost, insensitivity to interference (both unintended and intended), and electrical power consumption.

While alternate techniques are conceivable, we have presented the First and Second possible implementations to illustrate real-world realizations, which should not be construed as limiting the method contained in RRS.

We claim:

1. A Roulette Registration System (RRS) in which the collective bet in roulette is identified in terms of stacks, said stacks producing their composition (SC) in terms of type and their multiplicity, where said type discriminates coins at least by their monetary value, said stacks transmitting their SC to a central registration and processing system (RPS), said transmission being localized with respect to the table, said localization providing the location (L) of the SC for a complete stack composition and location (SCL).

2. An RRS as described in claim 1 with the property that the stack composition SC is obtained from the enumeration of coins by their individual type as contained in their coin identification data (CID), which sequence of CID's is generated in successive broadcasts, said broadcasts being performed by the individual coins in the order in which they appear in the stack.

3. An RRS as described in claim 2 using smart coins capable of (a1) detection of being at a top level position in a stack (TL), (a2) a broadcasting mode (BM) for broadcast of their type as contained in their CID, followed by an end-of-broadcast signal (EBS), (a3) a propagation mode (PM) for communicating messages between adjacent higher and lower level coins, or from an adjacent higher level coin to the table, (a4) detection, but no propagation, of an end-of-broadcast signal (dEBS), for producing the stack composition SC of a stack of n coins, in which the coin at the top level broadcasts its value first by TL and BM, and the coin at the bottom level broadcasts its value last, using a response of the coins at level l ($1 \leqq l \leqq n$) within said stack by their individual sequence of one or multiple actions PM, followed by a single dEBS, BM and EBS.

4. An RRS as described in claim 2 with the property that said broadcasts are performed by means of micro wave technology.

5. An RRS as described in claim 4 with the property that said table is endowed with a cartesian sensing grid made of pair-wise orthogonal electrically conducting sensing wires for receiving said stack compositions SC, relaying said SC to the central registration system, and determining the coordinates of the spot at which said SC is received with sufficient spatial resolution to resolve the bet associated with the individual stacks.

6. An RRS as described in claim 2 with the property that said broadcasts are performed by means of optical technology.

7. An RRS as described in claim 6 with the property that said table is endowed with a cartesian sensing grid CSG made of light sensitive elements for receiving stack compositions SC, said SCG possessing sufficient spatial resolution to resolve the bet associated with the location at which said stack composition.

8. An RRS as described in claim 1 with the property the stack composition SC is transmitted into a cartesian sensing grid (SCG) in the table, said SCG resolving the coordinates of the spot at which said SC is received with sufficient accuracy to determine the bet associated with the stack, said SCG being connected to the RPS.

9. A method of extending roulette to include remote players at distant sites with the property that said remote players are presented with a faithful, real-time representation of the proceeds of the game using RRS as described in claim 1, said real-time representation being communicated over a telecommunications network.

10. A method of gathering data of the proceeds of roulette games for analysis of the collective bet behavior in roulette with the property that said data are registered using RRS as described in claim 1.

11. A method of preventing fraud in roulette using registration of the proceeds of the game by application of RRS as described in claim 1.

12. A method of preventing fraud in roulette using registration of each individual coin using an individual identification number for each coin, which identification number is transmitted to the central registration system by means of RRS as described in claim 1.

* * * * *